US009704461B2

(12) United States Patent
Hennessey

(10) Patent No.: US 9,704,461 B2
(45) Date of Patent: Jul. 11, 2017

(54) STAND FOR STRINGED INSTRUMENT

(71) Applicant: James R. Hennessey, West Hartford, CT (US)

(72) Inventor: James R. Hennessey, West Hartford, CT (US)

(73) Assignee: The Music People, Inc., Berlin, CT (US)

( * ) Notice: Subject to any disclaimer, the term of this patent is extended or adjusted under 35 U.S.C. 154(b) by 0 days.

(21) Appl. No.: 14/883,147

(22) Filed: Oct. 14, 2015

(65) Prior Publication Data

US 2016/0104470 A1 Apr. 14, 2016

Related U.S. Application Data

(60) Provisional application No. 62/063,631, filed on Oct. 14, 2014.

(51) Int. Cl.
*G10D 3/00* (2006.01)
*G10G 5/00* (2006.01)

(52) U.S. Cl.
CPC ..... *G10G 5/00* (2013.01)

(58) Field of Classification Search
CPC ..... G10G 5/00
USPC ..... 84/327; 248/441.1, 443, 121
See application file for complete search history.

(56) References Cited

U.S. PATENT DOCUMENTS

2007/0125222 A1* 6/2007 Clifford ..... G10G 5/00 84/327
2008/0184866 A1* 8/2008 Hsieh ..... F16M 11/16 84/327
2015/0129523 A1 5/2015 Cortina

* cited by examiner

*Primary Examiner* — Jianchun Qin
(74) *Attorney, Agent, or Firm* — Whitmyer IP Group LLC

(57) ABSTRACT

A stand for a stringed instrument includes a base, a post, a lower support, and an upper support. The post extends between a lower end portion and an upper end portion, the lower end portion is proximally located relative to the base, and the upper end portion is distally located relative to the base. The lower support is disposed relative to the lower end portion of the post. The upper support is disposed relative to the upper end portion of the post. The lower support is selectively moveable relative to the upper support, between a receiving position and a locking position. The lower support is biased toward the locking position.

17 Claims, 5 Drawing Sheets

STAND FOR STRINGED INSTRUMENT

CROSS-REFERENCE TO RELATED APPLICATIONS

The present disclosure claims priority to U.S. Provisional Patent Application No. 62/063,631, filed Oct. 14, 2014.

FIELD OF THE INVENTION

The present invention relates to a support stand. More specifically, the present invention relates to a support stand for a stringed instrument (e.g., a guitar).

BACKGROUND OF THE INVENTION

It is known to provide a stand to support a stringed instrument (e.g., guitar, bass guitar, violin, guitar, sitar, viola, cello, harp, double bass, rebab, banjo, mandolin, ukulele, etc.) when the instrument is not being played but when ready access to the stringed instrument is desired (e.g., in a studio, during a performance, etc.).

FIG. 1 illustrates an example of a known stand 1 for a stringed instrument. The stand 1 is offered under the trademark ON-STAGE®. The stand 1 includes a base 2, a post 3 receivable in the base 1 and extending upwardly therefrom, a lower support 4 disposed relative to a lower end portion of the post 3, and an upper support 5 disposed relative to an upper end portion of the post 3. The lower support 4 forms a u-shape and is configured to support a body of a stringed instrument (not shown) in a substantially vertical position. The upper support 5 is configured to support a neck of the stringed instrument. The upper support 5 includes a security strap 6 for securing the neck of the stringed instrument in the upper support 5. A first end of the security strap 6 is connected to a first side of the upper support 5. A second end of the security strap 6 is removably connected to a second side of the upper support 5. After the neck of the stringed instrument is received in the security strap 6, the security strap 6 is connected across the opening of the upper support 5 to prevent the stringed instrument from tipping over and/or falling out of the stand 1. The distance between the lower support 4 and the upper support 5 is between 19.25" and 24", depending on how the post 3 is adjusted relative to the base 2.

A disadvantage of known stands for stringed instruments (e.g., the stand 1 shown in FIG. 1) is that they require a manual step to lock the security strap 6 across the upper support 5. This step can be disruptive when a musician is performing, or when the musician otherwise desires to quickly change instruments. Aspects of the present invention are directed to these and other problems.

SUMMARY OF THE INVENTION

According to an aspect of the present invention, a stand for a stringed instrument includes a base, a post, a lower support, and an upper support. The post extends between a lower end portion and an upper end portion, the lower end portion is proximally located relative to the base, and the upper end portion is distally located relative to the base. The lower support is disposed relative to the lower end portion of the post. The upper support is disposed relative to the upper end portion of the post. The lower support is selectively moveable relative to the upper support, between a receiving position and a locking position. The lower support is biased toward the locking position.

According to another aspect of the present invention, a stand for a stringed instrument includes a base, a post, a lower support, and an upper support. The post extends between a lower end portion and an upper end portion, the lower end portion is proximally located relative to the base, and the upper end portion is distally located relative to the base. The lower support is disposed relative to the lower end portion of the post. The upper support is disposed relative to the upper end portion of the post. The lower support is selectively moveable relative to the upper support, between a receiving position and a locking position. The lower support and the upper support are operable to receive a body of a stringed instrument therebetween when the lower support is in the receiving position. The lower support and the upper support are operable to positionally fix the body of the stringed instrument therebetween when the lower support is in the locking position.

According to another aspect of the present invention, a stand for a stringed instrument includes a base, a post, a lower support, and an upper support. The post extends between a lower end portion and an upper end portion, the lower end portion is proximally located relative to the base, and the upper end portion is distally located relative to the base. The lower support is disposed relative to the lower end portion of the post. The upper support is disposed relative to the upper end portion of the post. The lower support is selectively moveable relative to the upper support, between a receiving position and a locking position. The lower support and the upper support are configured such that a first distance extends therebetween when the lower support is in the receiving position, and a second distance extends therebetween when the lower support is in the locking position. The first distance is greater than the second distance.

In addition to, or as an alternative to, one or more of the features described above, further aspects of the present invention can include one or more of the following features, individually or in combination:

- a first distance extends between the lower support and the upper support when the lower support is in the receiving position, a second distance extends between the lower support and the upper support when the lower support is in the locking position, and the first distance is greater than the second distance;
- the first distance corresponds to a distance extending between opposing ends of a stringed instrument body;
- the lower support and the upper support are operable to receive a body of a stringed instrument therebetween when the lower support is in the receiving position;
- the lower support and the upper support are operable to positionally fix a body of a stringed instrument therebetween when the lower support is in the locking position;
- the base is configured to support a weight and maintain stability of the stand and a stringed instrument supported by the stand;
- the post extends upwardly from the base and includes a lower tube and an upper tube, the lower tube defines the lower end portion of the post and is connected to the base, and the upper tube defines the upper end portion of the post, and the lower tube and the upper tube each have a bore extending axially therethrough defining a cavity;
- the lower tube and the upper tube are connected together in a telescoping fashion, and the stand further comprises an adjustment member between the lower tube and the upper tube operable to adjust a relative position of the lower tube and the upper tube;

the lower support is configured to support a body of a stringed instrument at a first end of the body opposite a neck of the stringed instrument;

the lower support includes an arm arranged perpendicular to the post, the arm extends through and is slidably engaged with two slots formed in opposing surfaces of the post; and the arm is operable to translate relative to the post along a path defined by the two slots;

the upper support is configured to engage an end of a body of a stringed instrument from which a neck of the stringed instrument extends;

the upper support includes a mount connected to the post, and an arm that extends from the mount for engagement with the end of the body of the stringed instrument;

the stand further comprises a biasing mechanism for biasing the lower support toward the locking position, the biasing mechanism includes a first plate positionally fixed within a cavity of the post, a second plate within the cavity and slidably engaged with an inner surface of the post that defines the cavity, and a spring connected between the first plate and the second plate, and the lower support is connected to the second plate biasing mechanism; and the spring has an equilibrium length and spring constant that allow the spring to provide sufficient biasing force to bias the first support toward locking position when a stringed instrument is supported on the stand.

These and other aspects of the present invention will become apparent in light of the drawings and detailed description provided below.

DETAILED DESCRIPTION OF THE INVENTION

Figure 1:
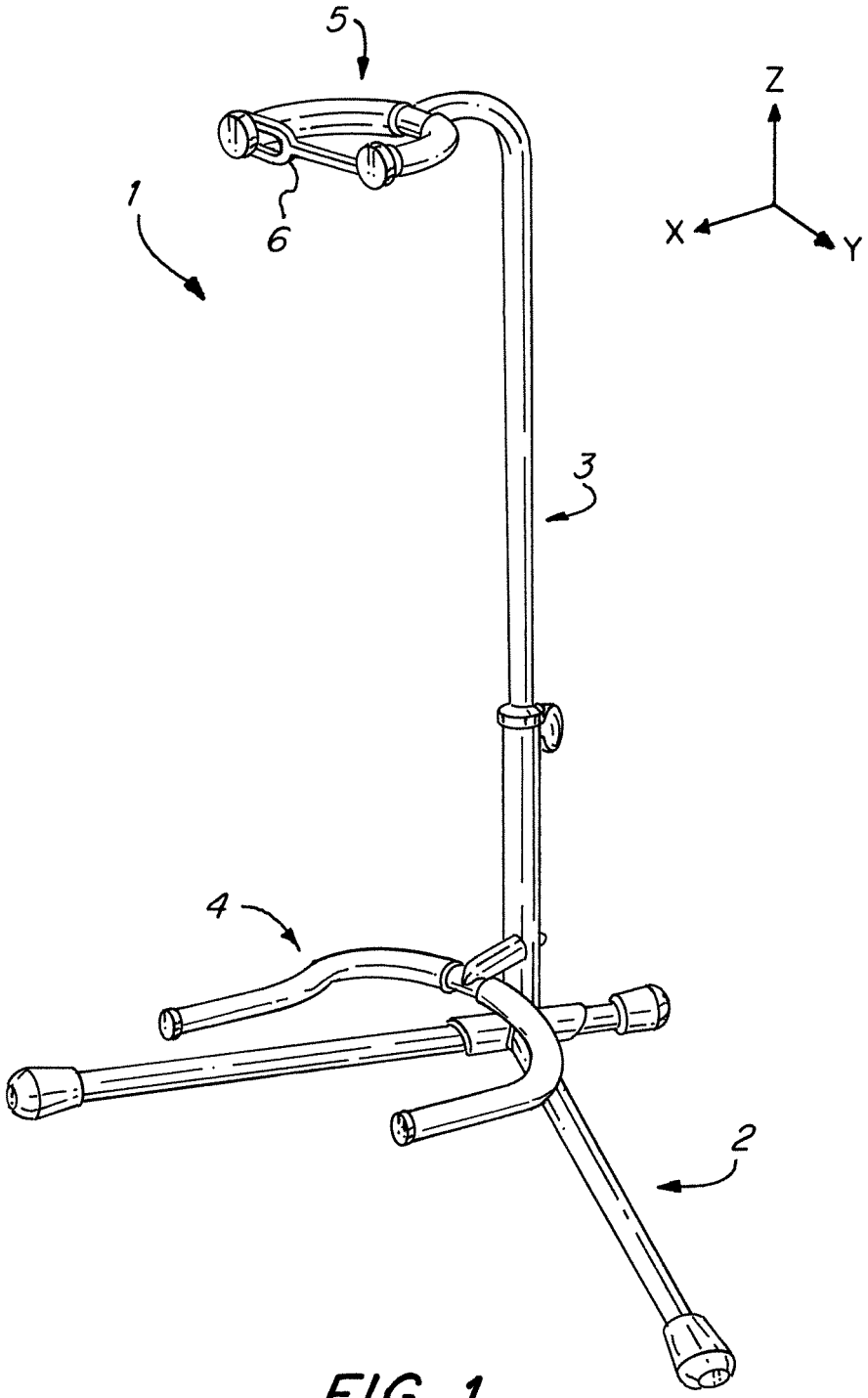
FIG. 1 (PRIOR ART)
FIG. 1 is a view of a prior art stand for a stringed instrument.

Referring to FIGS. 2-5, the present disclosure describes embodiments of a stand for a stringed instrument (hereinafter the "stand 10"). The present disclosure describes aspects of the stand 10 with reference to the exemplary embodiments illustrated in the drawings; however, aspects of the stand 10 are not limited to the exemplary embodiments illustrated in the drawings. The present disclosure may describe one or more features of the stand 10 as having a length extending relative to an x-axis, a width extending relative to a y-axis, and/or a height extending relative to a z-axis. The drawings illustrate the respective axes.

Referring to FIGS. 2-5, the stand 10 includes a base 12, a post 14, a lower support 16, an upper support 18, and a biasing mechanism 20. The post 14 extends between (i) a lower end portion proximally located relative to the base 12 and (ii) an upper end portion distally located relative to the base 12. The lower support 16 is disposed relative to the lower end portion of the post 14, and the upper support 18 is disposed relative to the upper end portion of the post 14. The lower support 16 is selectively moveable relative to the upper support 18, between a receiving position (see FIGS. 2 and 3) and a locking position (see FIG. 4). The biasing mechanism 20 biases the lower support 16 toward the locking position. When the lower support 16 is in the receiving position, a first distance extends between the lower support 16 and the upper support 18, and the lower support 16 and the upper support 18 are operable to receive a body of a stringed instrument (not shown) therebetween. When the lower support 16 is in the locking position, a second distance that is less than the first distance extends between the lower support 16 and the upper support 18, and the lower support 16 and the upper support 18 are operable to positionally fix the body of the stringed instrument therebetween.

The base 12 is configured to support the weight and maintain the stability of the other components of the stand 10, as well as a stringed instrument (not shown) supported by the stand 10. The base 12 can be configured in various different ways to achieve this and other functionality. In the illustrated embodiment, for example, the base 12 includes three legs 22 that collectively form a tripod.

Figure 2:
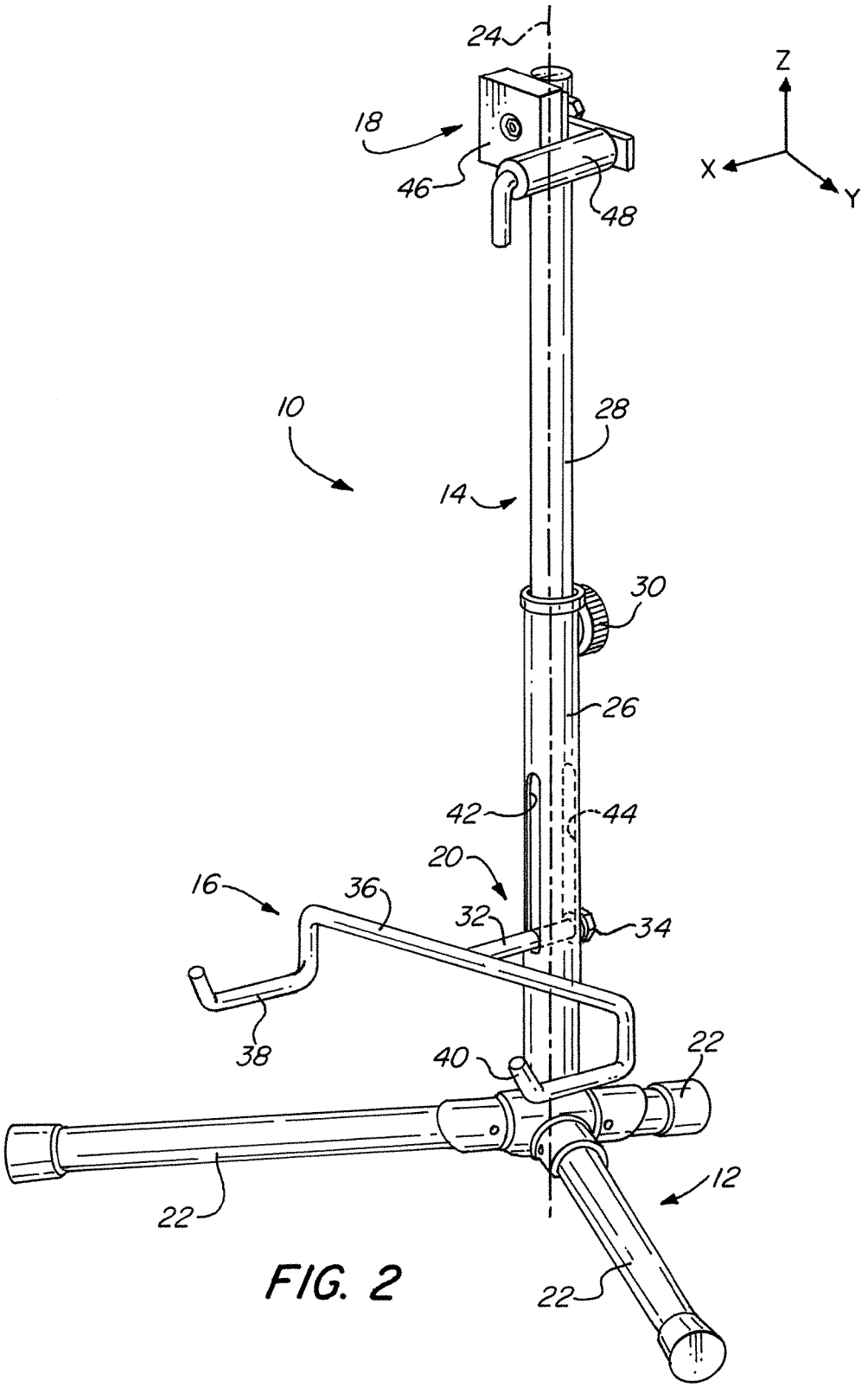
FIG. 2 is a perspective view of an embodiment of the present stand for a stringed instrument.

The post 14 extends upwardly from the base 12 along a heightwise-extending axis 24 (see FIG. 2). In some embodiments, the post 14 includes a single elongate member. In other embodiments, the post 14 includes multiple elongate members. In the illustrated embodiment, for example, the post 14 includes a lower tube 26 and an upper tube 28. The lower tube 26 defines the lower end portion of the post 14 and is connected to the base 12, and the upper tube 28 defines the upper end portion of the post 14. The lower tube 26 and the upper tube 28 each have a circular cross-sectional shape, and each have a bore extending axially therethrough defining a cavity.

In some embodiments in which the post 14 includes multiple elongate members, the elongate members can be positionally fixed relative to one another (e.g., by a threaded connection therebetween). In other embodiments, the elongate members can be adjustably connected to one another. In the illustrated embodiment, for example, the lower tube 26 and the upper tube 28 are connected together in a telescoping fashion, and the stand 10 includes an adjustment member 30 (see FIG. 2) between the lower tube 26 and the upper tube 28 for adjusting the relative positioning thereof. This, in turn, allows for adjustment of the distance between the lower support 16 and the upper support 18 to accommodate different sized stringed instruments. In the illustrated embodiment, the upper tube 28 include a plurality of holes in a surface thereof having a width that corresponds to an outside diameter of an engagement member protruding from the adjustment member 30. The adjustment member 30 is moveable between a closed position and an open position. As the adjustment member 30 is moved from the open position to the closed position, the engagement member can be received in one of the corresponding holes, thereby fixing the position of the upper tube 28 relative to the lower tube 26. The adjustment member 30 can be moved to the open position by rotating the adjustment member 30 in a first direction. In the open position, the upper tube 28 can be translated relative to the lower tube 26.

The lower support 16 of the stand 10 is configured to support the body of a stringed instrument (not shown) at a first end of the body opposite the neck of the stringed instrument. The lower support 16 can have various different shapes and sizes. The shape and size of the lower support 16 can be selected, for example, so that the lower support 16 can accommodate one or more stringed instruments having particular shapes and sizes (e.g., thicknesses).

In the illustrated embodiment, the lower support 16 includes an arm 32, a knob 34 connected to a first end of the arm 32, a crossbar 36 connected to an opposing second end of the arm 32, and hooks 38, 40 connected to the ends of the crossbar 36. The arm 32 is arranged perpendicular to the lower tube 26 of the post 14. The arm 32 of the lower support 16 extends through and is slidably engaged with two axially-extending slots 42, 44 formed in opposing surfaces of the lower tube 26 of the post 14. The arm 32 can translate relative to the lower tube 26 along the path defined by the slots 42, 44. The knob 34 of the lower support 16 is connected to the second end of the arm 32 so as to retain the arm 32 in the slots 42, 44 of the lower tube 26. In the illustrated embodiment, the knob 34 is removably connected to the first end of the arm 32 (e.g., via a threaded engagement) so as to permit the knob 34 to be removed from the arm 32 and to thereby permit the lower support 16 to be removed from engagement with the lower tube 26 of the post 14. In other embodiments, the knob 34 is permanently connected to the second end of the arm 32.

The upper support 18 of the stand 10 is configured to engage a second end of the body of the stringed instrument (not shown) from which the neck of the stringed instrument extends. The upper support 18 can have various different shapes and sizes. The shape and size of the upper support 18 can be selected, for example, so that the upper support 18 can accommodate one or more stringed instruments having particular shapes and sizes (e.g., thicknesses).

In the illustrated embodiment, the upper support 18 includes a mount 46 connected to the upper tube 28 of the post 14, and an arm 48 that extends from the mount 46 for engagement with the second end of the end of the body of the stringed instrument. The arm 48 includes a downwardly extending portion at its distal end. This can aid in enabling the stand 10 to retain the cutaway section of a body of a stringed instrument, for example.

Figure 3:
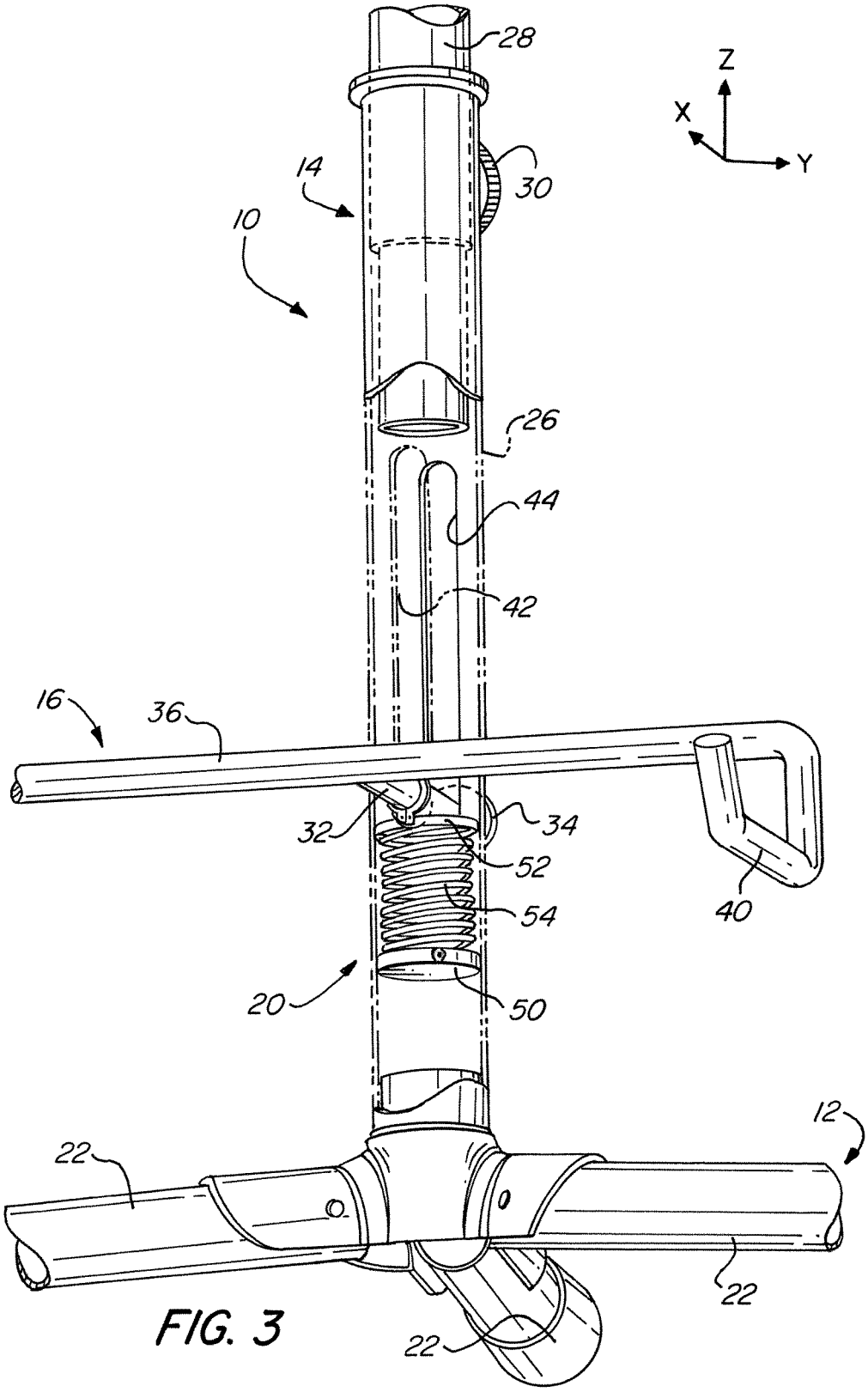
FIG. 3 is a perspective view of a portion of the stand in FIG. 2.
Figure 4:
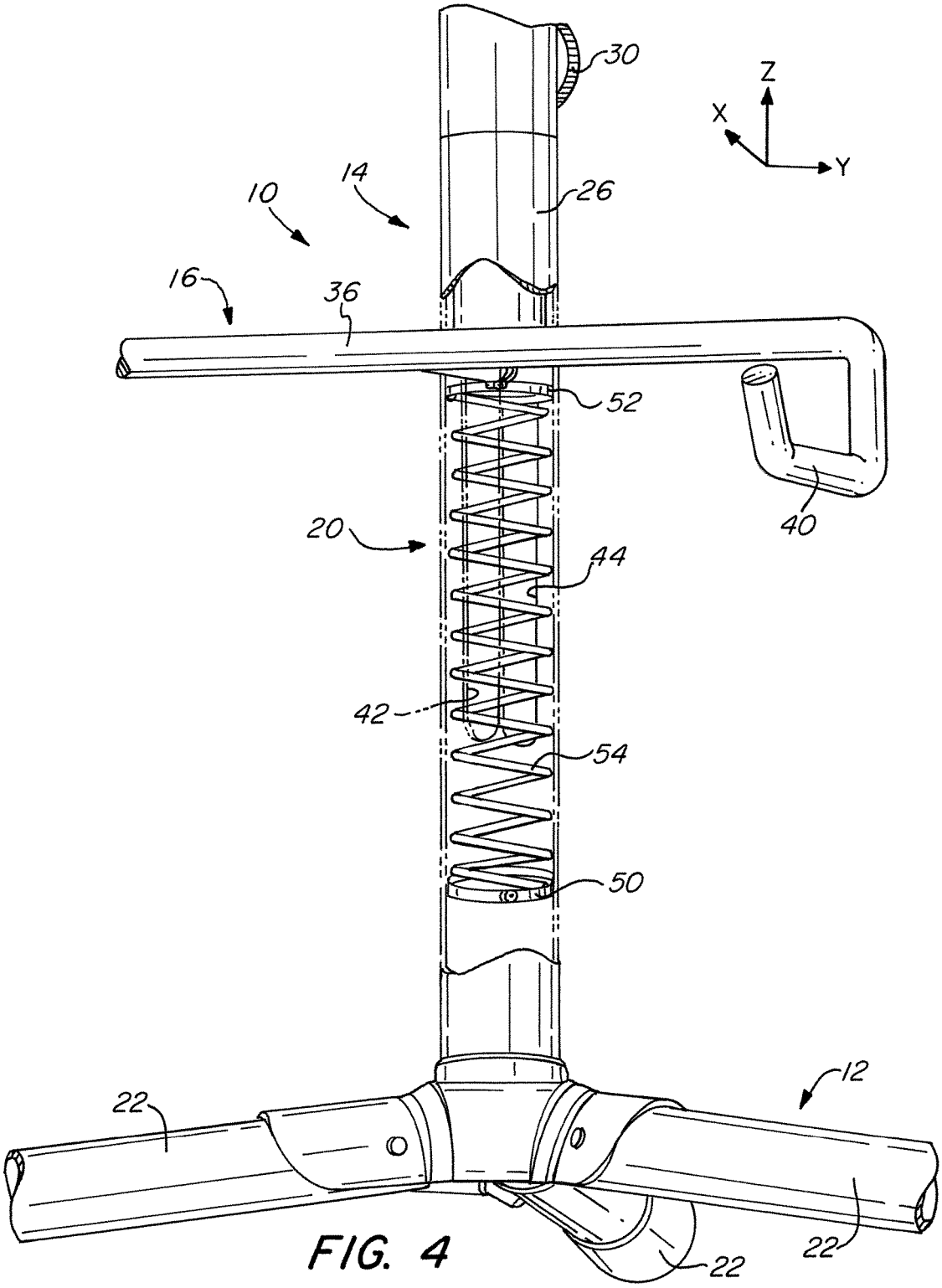
FIG. 4 is a perspective view of a portion of the stand in FIG. 2.
Figure 5:
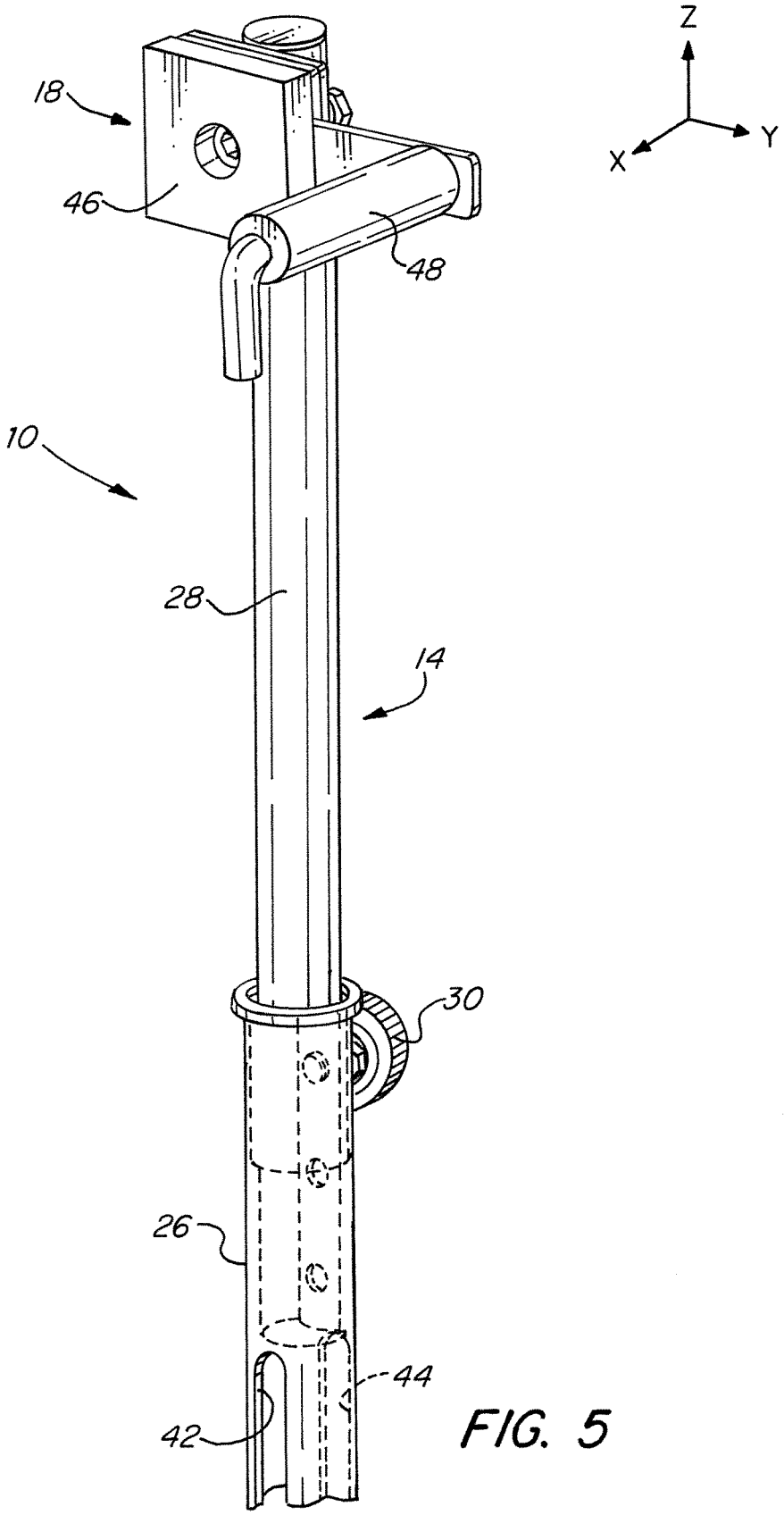
FIG. 5 is a perspective view of a portion of the stand in FIG. 2

The biasing mechanism 20 can be configured in various different ways. Referring to FIGS. 3 and 4, in the illustrated embodiment, the biasing mechanism 20 includes a first plate 50, a second plate 52, and a spring 54. The first plate 50 is positionally fixed within the cavity of the lower tube 26 of the post 14. The first plate 50 can be positionally fixed within the cavity by any known means, including, but not limited, a pin or a weld. The first plate 50 is positioned between a bottom of the opposing slots 42, 44 and the base 12 of the stand 10. The second plate 52 is slidably engaged with the inner surface of the lower tube 26 that defines the cavity. The second plate 52 is positioned above the first plate 50. The arm 32 of the lower support 16 is connected to the second plate 52 of the biasing mechanism 20. A first end of the spring 54 is connected the first plate 50, and an opposing second end of the spring 54 is connected to the second plate 52. The spring 54 has an equilibrium length and spring constant that allow the spring 54 to provide sufficient biasing force to bias the second plate 52 (and thus the arm 32 of the lower support 16) toward the upper ends of slots 42, 44 to thereby retain the stringed instrument in the stand 10, while at the same time not causing damage to the finish to the stringed instrument. The equilibrium length and the spring constant can vary, for example, depending on the sizes and/or shapes of the particular stringed instruments that are intended to be used with the stand 10.

The dimensions of the stand 10, and the components thereof, can vary for example, depending on the sizes and/or shapes of the particular stringed instruments that are intended to be used with the stand 10. In some embodiments, the distance between the lower support 16 and the upper support 18 can be between 19.25" and 24", depending on how the post 14 is adjusted.

During use of the stand 10, a user can place a body of a stringed instrument (not shown) on the lower support 16 and can push down to thereby compress the spring 54 and move the lower support 16 relative to the upper support 18. The stringed instrument can then be tilted into the stand 10 so that the neck of the stringed instrument contacts the mount 46 of the upper support 18. The user can then release the stringed instrument, and the spring 54 will bias the lower support 16 (and the stringed instrument resting thereon) toward the upper support 18, until the body of the instrument is compressed between the lower support 16 and the arm 32 of the upper support 18, thereby positionally fixing the stringed instrument therebetween.

While several embodiments have been disclosed, it will be apparent to those of ordinary skill in the art that aspects of the present invention include many more embodiments and implementations. Accordingly, aspects of the present invention are not to be restricted except in light of the attached claims and their equivalents. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A stand for a stringed instrument, comprising:

a base;

a post extending between a lower end portion and an upper end portion, the lower end portion being proximally located relative to the base, and the upper end portion being distally located relative to the base;

a lower support disposed relative to the lower end portion of the post; and an upper support disposed relative to the upper end portion of the post;

the lower support being selectively moveable relative to the upper support between a receiving position and a locking position, and the lower support biased toward the upper support.

2. The stand of claim 1, wherein a first distance extends between the lower support and the upper support when the lower support is in the receiving position, a second distance extends between the lower support and the upper support when the lower support is in the locking position, and the first distance is greater than the second distance.

3. The stand of claim 2, wherein the first distance corresponds to a distance extending between opposing ends of a stringed instrument body.

4. The stand of claim 1, wherein the lower support and the upper support are operable to receive a body of a stringed instrument therebetween when the lower support is in the receiving position.

5. The stand of claim 1, wherein the lower support and the upper support are operable to positionally fix a body of a stringed instrument therebetween when the lower support is in the locking position.

6. The stand of claim 1, wherein the base is configured to support a weight and maintain stability of the stand and a stringed instrument supported by the stand.

7. The stand of claim 1, wherein the post extends upwardly from the base and includes a lower tube and an upper tube;

wherein the lower tube defines the lower end portion of the post and is connected to the base, and the upper tube defines the upper end portion of the post; and wherein the lower tube and the upper tube each have a bore extending axially therethrough defining a cavity.

8. The stand of claim 7, wherein the lower tube and the upper tube are connected together in a telescoping fashion, and the stand further comprises an adjustment member between the lower tube and the upper tube operable to adjust a relative position of the lower tube and the upper tube.

9. The stand of claim 1, wherein the lower support is configured to support a body of a stringed instrument at a first end of the body opposite a neck of the stringed instrument.

10. The stand of claim 1, wherein the lower support includes an arm arranged perpendicular to the post;

wherein the arm extends through and is slidably engaged with two slots formed in opposing surfaces of the post; and wherein the arm is operable to translate relative to the post along a path defined by the two slots.

11. The stand of claim 1, wherein the upper support is configured to engage an end of a body of a stringed instrument from which a neck of the stringed instrument extends.

12. The stand of claim 11, wherein the upper support includes a mount connected to the post, and an arm that extends from the mount for engagement with the end of the body of the stringed instrument.

13. The stand of claim 1, wherein the stand further comprises a biasing mechanism for biasing the lower support toward the locking position;

wherein the biasing mechanism includes a first plate positionally fixed within a cavity of the post, a second plate within the cavity and slidably engaged with an inner surface of the post that defines the cavity, and a spring connected between the first plate and the second plate; and wherein the lower support is connected to the second plate biasing mechanism.

14. The stand of claim 13, wherein the spring has an equilibrium length and spring constant that allow the spring to provide sufficient biasing force to bias the first support toward locking position when a stringed instrument is supported on the stand.

15. A stand for a stringed instrument, comprising:

a base;

a post extending between a lower end portion and an upper end portion, the lower end portion being proximally located relative to the base, and the upper end portion being distally located relative to the base;

a lower support disposed relative to the lower end portion of the post; and an upper support disposed relative to the upper end portion of the post;

the lower support being selectively moveable relative to the upper support, between a receiving position and a locking position;

a biasing mechanism biasing the lower support toward the locking position, the biasing mechanism including a first plate positionally fixed within a cavity of the post, a second plate within the cavity and slidably engaged with an inner surface of the post that defines the cavity, and a spring connected between the first plate and the second plate, the lower support being connected to the second plate biasing mechanism;

the lower support and the upper support being operable to receive a body of a stringed instrument therebetween when the lower support is in the receiving position; and the lower support and the upper support being operable to positionally fix the body of the stringed instrument therebetween when the lower support is in the locking position.

16. A stand for a stringed instrument, comprising:

a base;

a post extending between a lower end portion and an upper end portion, the lower end portion being proximally located relative to the base, and the upper end portion being distally located relative to the base;

a lower support disposed relative to the lower end portion of the post; and an upper support disposed relative to the upper end portion of the post;

the lower support being selectively moveable relative to the upper support, between a receiving position and a locking position, and the lower support biased towards the upper support;

the lower support and the upper support being configured such that a first distance extends therebetween when the lower support is in the receiving position, a second distance extends therebetween when the lower support is in the locking position, and the first distance is greater than the second distance.

17. The stand of claim 16, wherein the first distance corresponds to a distance extending between opposing ends of a stringed instrument body.

* * * * *